US006302779B1

(12) United States Patent
Ryan et al.

(10) Patent No.: US 6,302,779 B1
(45) Date of Patent: Oct. 16, 2001

(54) FUME HOOD

(75) Inventors: Raymond F. Ryan, Wilmington; Robert J. Oppel, Rural Hall, both of NC (US)

(73) Assignee: Flow Sciences, Inc., Wilmington, NC (US)

( * ) Notice: Subject to any disclaimer, the term of this patent is extended or adjusted under 35 U.S.C. 154(b) by 0 days.

(21) Appl. No.: 09/524,832

(22) Filed: Mar. 14, 2000

(51) Int. Cl.[7] ..... B08B 15/02
(52) U.S. Cl. ..... 454/61; 454/56
(58) Field of Search ..... 454/59, 56, 61; 126/299 R, 299 D

(56) References Cited

U.S. PATENT DOCUMENTS

| | | |
|---|---|---|
| 4,706,553 | 11/1987 | Sharp et al. . |
| 4,934,256 | 6/1990 | Moss et al. . |
| 5,092,227 | 3/1992 | Ahmed et al. . |
| 5,240,455 | 8/1993 | Sharp . |
| 5,415,583 | 5/1995 | Brandt, Jr. . |
| 5,518,446 | 5/1996 | Jacob . |
| 5,535,634 | 7/1996 | Traina et al. . |
| 5,697,838 | 12/1997 | Morris . |
| 5,730,652 | 3/1998 | Van Becelaere . |

*Primary Examiner*—Harold Joyce
*Assistant Examiner*—Derek S. Boles
(74) *Attorney, Agent, or Firm*—Rhodes & Mason, PLLC

(57) ABSTRACT

A regulator is provided for maintaining a preset air velocity through the work chamber of a fume hood. The regulator compares a measured air velocity at the inlet into the chamber with a preset air velocity and adjusts air velocity in response to differences in measured and preset values. Air velocity is measured with a high sensitivity pitot with an exterior end to be positioned outside the fume hood, and an interior end to be positioned inside the fume hood. The pitot includes spaced parallel plates with front and rear ends, an exterior air pressure sensor positioned at the front end of the plates, and an interior air pressure sensor positioned at the rear end of the plates. The interior air pressure sensor includes openings substantially equidistant between the plates that are toward the rear of the pitot when the pitot is mounted on a fume hood. The exterior end of the pitot preferably curves below horizontal to minimize the effect of transient air currents. Face velocities as low as five linear feet per minute can be measured.

15 Claims, 2 Drawing Sheets

FUME HOOD

BACKGROUND OF THE INVENTION (1) Field of the Invention

The present invention relates to improved fume hoods or ventilated workstations, and in particular to fume hoods that include a highly sensitive air velocity regulator to measure and maintain the minimal face velocity necessary to prevent exhausting of the hood gases through the hood opening.

(2) Description of the Prior Art

Fume hoods or vented workstations are used in laboratories and other environments to manipulate materials that might generate noxious or dangerous gases or fumes without releasing the materials or components or fumes therefrom, into the work environment. Generally these workstations are comprised of an enclosure or chamber in which materials are handled, and means for drawing air through a front opening in the enclosure that is also used by the operator as means of access into the enclosure. The enclosure also includes an exhaust opening, frequently communicating with a filter to remove contaminants from air exhausted from the chamber.

The fume hood is normally comprised of side and top walls, which may be of transparent material, such as Plexiglas™ or other clear plastic, a rear wall with an exhaust opening, and a planar bottom wall or floor. The front edges of the top, side and bottom walls may form an operator access opening. A slidable door may be positioned to cover, or vary the size of, the access opening. Generally, the hood is configured, and air vanes are often added, so that air enters the access door and is exhausted through the exhaust opening, with generally laminar air flow being maintained within the chamber, preventing turbulence that could disturb the materials being manipulated.

Escape of contaminated air from the hood chamber through the access opening into the work environment is prevented by maintaining a pressure differential between the chamber, or hood interior, and the work environment, or hood exterior, so that air continually flows from the hood exterior through the access opening into the hood interior. A sufficient air velocity at the access opening, known as the "face velocity," must be maintained to prevent contaminated air from escaping. From an economic standpoint, however, it is important to not employ an air flow velocity greater than is necessary.

Contaminated air is exhausted from a fume hood through an exhaust conduit that includes a vacuum source to draw the air through the exhaust conduit. Generally, this vacuum source is comprised of an exhaust fan positioned within the conduit, and an electric motor to turn the fan. The gas may be exhausted to the exterior environment. In many instances, however, the air will be conveyed through a filter, such as a HEPA filter, to remove contaminants from the air.

The cost of operating a fume hood is attributable to the cost of electricity necessary to maintain the external environments, and to operate the exhaust motor. The initial cost of the hood will be largely dependent upon the size of the motor and other components of the exhaust system that is required. Since exhaust fans may run more or less constantly, a small difference in the size or speed of the motor can make a significant difference in the hood initial cost and its operating cost. Therefore, it is important to minimize the volume of air that flows through the hood chamber during operation.

Air flow is normally controlled by sensing the air velocity at the access opening or inlet into the hood, i.e., the face velocity, to maintain a velocity sufficient to prevent leakage of contaminated air. The measured velocity is then compared against a desired velocity, and a signal is transmitted to a control mechanism that adjusts the rate of air flow through the exhaust conduit. The flow rate can be adjusted by varying the motor and fan speed. However, since the velocity needs to be quickly adjusted, the control mechanism normally changes the position of a valve or damper within the exhaust conduit.

Various prior art hoods and control mechanisms incorporate these components.

For example U.S. Pat. No. 5,415,583 to Brandt, Jr. describes a fume hood and air flow control system comprised of a hood having an air access opening, a sensing means at the opening to determine face velocity, an exhaust means that includes a conduit and a valve positioned in the conduit, a pressure comparator, and an actuator. The sensing means is a pitot that reads total and static pressures. These readings are transmitted to the comparator, which in turn sends a signal to the actuator. The actuator then adjusts the valve position to change the air flow through the hood chamber.

The Brandt pitot is basically a pair of parallel tubes joined by a pair of parallel plates, with each plate having front and rear edges that are attached to the tubes. The front tube, e.g., the tube to the exterior of the chamber, includes a plurality of holes at the front of the tube extending through the tube wall into the tube interior. The rear tube, e.g., the tube to the interior of the chamber, also includes a plurality of holes that extend vertically downward through a plate and the tube wall into the tube interior. The hood includes a pair of spaced parallel, curved airfoils stacked above the lower edge of the access opening with the pitot being positioned between, and spaced from, the airfoils.

While the Brandt, Jr. patent and other prior art patents describe hood air velocity sensors and flow control mechanisms in fume hoods including these sensors, there is a continuing need for further improvements in air flow sensors and mechanisms that would provide greater sensitivity to fluctuations in air flow. Such sensors, by having the capability to measure air flow changes at lower air flows, would lessen the volume of air that is required to maintain a necessary face velocity, thereby reducing manufacturing and operational costs.

SUMMARY OF THE INVENTION

The fume hood of the present invention is comprised of an enclosure or chamber within which materials are manipulated or worked upon by the operator, an air exhaust mechanism for removing air from the enclosure, and a regulator for controlling the air flow through the chamber responsive to changes in air velocity at the inlet into the enclosure.

The enclosure is comprised of a work chamber with an access opening and an exhaust or discharge opening. The enclosure may include a pair of spaced, parallel side walls; rear and upper walls joining the side walls; and a bottom wall or floor, that together define the work chamber. The front edges of the side, upper and bottom walls define an access opening or inlet into the chamber through which the operator manipulates material within the chamber. Air also enters the chamber through this access opening. The hood may also include a moveable closure or door to vary the size of the access opening. The air exhaust opening is preferably located on the opposite side of the chamber from the access opening, so that air flows across the chamber from the access opening to the discharge opening.

The side walls and/or upper wall of the enclosure are preferably of a clear, impact resistant plastic to facilitate viewing of the chamber contents. The plastic should be of a thickness sufficient to withstand breakage during use. A thickness of three-fourths inch will normally be sufficient.

The bottom wall or floor of the enclosure is preferably comprised of a planar work surface with connecting rear, side and front shoulders or edges to form a sink for collecting any material spilled in the chamber. The rear and side shoulders desirably have a top surface, a vertical outer face, and a curved inner face extending upwardly from the planar work surface or floor to the top wall of the shoulder.

The front shoulder of the bottom wall is curved inwardly to serve the additional function of aiding in the production of laminar air flow within the chamber, and includes a top surface, a vertical, front or outer face, and a concave rear or inner face with a semi-circular cross-section. The bottom wall is preferably of a chemically resistant material, such as Corian®.

The bottom wall will generally have a width of from about 24 to about 48 inches and a depth of from about 18 to about 24 inches. The height of the shoulders above the floor is a matter of design choice, but will generally be in the range of ¼ to 1 inch. The amount of spilled liquid which can be contained by the bottom wall will depend on the height of the inner faces and the width and depth of the bottom wall. For example, a bottom wall 24 inches wide and 19 inches deep with a one-half inch inner face will hold approximately 1.5 liters of liquid, while a bottom wall 48 inches wide and 19 inches deep with a one-half inch inner face will hold approximately 3.0 liters of liquid.

Air is preferably exhausted from the chamber through one or more exhaust openings in the chamber rear wall that is in communication with a plenum. The plenum includes an interior chamber, preferably formed of a pair of spaced side walls extending rearwardly from the rear enclosure wall, a back wall spaced from the rear wall, a bottom wall extending upwardly at an angle from the rear wall to the back wall, and a top wall.

The exhaust openings are preferably a pair of spaced horizontal slots extending across the rear of the chamber. To optimize laminar flow, the lower slot is approximately twice the size of the upper slot, and is located adjacent the lower edge of the plenum, while the smaller upper slot is located adjacent the top of the plenum. An exhaust conduit attachment opening is normally located in the plenum back or top wall to join the plenum to an exhaust conduit.

The exhaust conduit is in communication with an exhaust fan, such as an in-line duct fan, or other vacuum source, to draw air from the chamber, and through the conduit. The air exiting the conduit is then exhausted to the atmosphere. Preferably, contaminants are first removed from the air by conveying the air through a filter medium, ideally a HEPA filter, contained within a housing that also includes a collection chamber. The volume of air conveyed through the exhaust conduit is controlled by an in-line valve or damper that is rotated to any position between closed and fully open positions by a control means such as a stepping motor.

Positioning of the valve, and thus the rate of air flow through the chamber, is controlled by a regulator comprised of a sensor to collect information relating to the face velocity of air entering the chamber; a converter, such as a pressure transducer, to convert sensed information into an electrical signal, a controller to compare the electrical signal against a preset value and transmit a control signal when the values are different, and a valve actuator to change the position of the valve in response to a control signal received from the controller.

The sensor of the present invention is a uniquely designed pitot that measures pressures with greater sensitivity, and also eliminates the need for air vanes previously used with such sensors. The present pitot, like the Brandt, Jr. pitot, is comprised of a pair of parallel plates with front and rear edges, and a pair of parallel tubes that are positioned between the edges of the plates. Like Brandt Jr., each tube includes holes that communicate with the interior of the tube.

However, the pitot of the present invention includes several important differences. In the Brandt, Jr. pitot, the holes or openings in the rear tube are aligned vertically and extend radially downward from the upper plate along a line through the center of the rear tube. Surprisingly, it has been found that the sensitivity of the pitot is greatly improved, and significantly lower face velocities can be measured, if the holes into the rear tube are positioned at the rear of the rear tube. That is, the holes are aligned radially horizontally at the rear of the rear tube. In this position, the holes are equidistant between the exterior surfaces of the upper and lower plates. It has been found that the pitots of the present invention, with the holes in the rear tube in this orientation can be used to measure face velocities when the linear face velocity is as low as five linear feet per minute. This extremely low flow rate substantially reduces operating cost, and significantly improves the accuracy of control.

In a preferred embodiment, sensitivity of the pitot is further improved by minimizing measurement interferences due to transient air currents. This interference is minimized by curving the front or exterior end of the pitot at an angle below horizontal. That is, the pitot is in the configuration of an airfoil with each pitot plate being comprised of a generally horizontal rear section and a downwardly curved front section.

Preferably, the front section is about one-half to about one-third the length of the rear section. The front ends of the parallel plates, and thus the front end of the pitot, are normally inclined downwardly at an angle of from about 30° to about 50° below horizontal. That is, a line drawn perpendicular to the plane of the front edges of the pitot will be at a 30–50° angle below horizontal.

Each pitot plate includes a rear edgy and a front edge, with a first tube being attached to the plates adjacent their front edges, and a second tube being attached to the plates adjacent the rear edges. Then front tube includes a plurality of holes that extend through the tube wall into the tube interior. When the front section is curved, these holes are positioned radially at an angle of from about 30° to about 50° below horizontal. That is, a line through the center of the tube and a given hole will be at an angle of from 30–50° below horizontal. Preferably, the holes are spaced equidistant along the front tube, and are separated at a distance of from about 4 to about 8 inches.

The rear tube also includes a plurality of holes extending through the tube wall into the tube interior. Preferably, these holes are also spaced equidistant alone the rear tube, with a separation distance normally of from about 4 to about 8 inches. The rear tube holes, however, are positioned on the rear of the tube along a line parallel to the plates at the rear of the pitot, and along the horizontal radius of the rear tube. The rear holes are equidistant between the upper and lower surfaces of the parallel plates.

The pitot preferably has an overall length, measured along a horizontal line from the rear edge to the front edge, of from about 4 to about 8 inches, preferably about 5 to about 6 inches, and a thickness, measured from the upper to the lower surface of the pitot of from about one-quarter to about three-quarters inches. The pitot plates will normally have a thickness of from about 0.0625 inch ±20%. The rear and front tubes, since each tube joins the corresponding ends of two plates, will be from about one-quarter to about three-quarter inches in exterior diameter, less the thicknesses of the plates. The holes will normally be about 0.032 inches ±20% in diameter. The width of the pitot will correspond to the width of the bottom edge of the access opening.

The unique pitot design exhibits several advantages over prior art pitot designs in addition to the greater measurement sensitivity resulting from placement of the rear holes, and the minimization of interference from transient air currents due to the downward front curvature. First, since the pitot upper and lower walls are curved, the pitot also serves as an airfoil to impart laminar flow to air entering into the hood chamber, eliminating the need for separate air foils. In addition, the smaller profile of the pitot, as compared to the thickness of prior art air foil/pitot combinations, and the proximity of the sensor holes to the air foil surfaces, further enhances measurement sensitivity, and a resultant greater control of air velocity.

Unlike prior art designs, the present pitot is mounted above the lower wall of the access opening, preferably at a distance of from about 1.5 to about 2.0 inches, and not between separate air foils. As noted previously, the floor of the chamber includes a front wall with a generally horizontal top surface and a concave inner surface. It is believed that a front wall of this configuration and a pitot with the above configuration act together to enhance laminar flow.

The pitot communicates with a converter, such as a transducer, that converts pressures measured within the interiors of the tubes and compares the pressures to determine the face velocity at a given time. This converter then transmits this information to a controller that compares the measured face velocity to a preset face velocity. If the measured face velocity is different from the preset value, the controller sends an appropriate signal to the actuator to open or close the valve, thereby increasing or decreasing air flow, as appropriate.

Accordingly, it is the aspect of the present invention to provide a pitot to measure air velocity at the inlet of a fume hood chamber comprising upper and lower parallel plates, and a rear velocity measurement tube between the rear edges of the plate the rear tube including openings toward the rear of the rear tube positioned along the horizontal radius of the rear tube.

It is a further aspect of the invention to provide an airfoil having a substantially horizontal rear section extending into said chamber and a downwardly curved front section extending to the exterior of said chamber, the airfoil having a front edge and a rear edge; an exterior air pressure sensor at the front edge of the airfoil; and an interior air pressure sensor at the rear edge of said airfoil, the interior air sensor including openings substantially equidistant between the upper and lower surfaces of the airfoil.

Another aspect of the invention is to provide a fume hood comprising a chamber having in inlet and an outlet; a vacuum source for drawing air through said inlet and said chamber, and out of said outlet; an airflow regulator for creating a predetermined air velocity through said air inlet; and a pitot of the preceding construction in communication with said regulator to measure air velocity at said inlet.

Other aspects of the invention will be apparent to one skilled in the art upon reading the following Drawings and the Detailed Description of the Preferred Embodiment.

DETAILED DESCRIPTION OF THE PREFERRED EMBODIMENT

Figure 1:
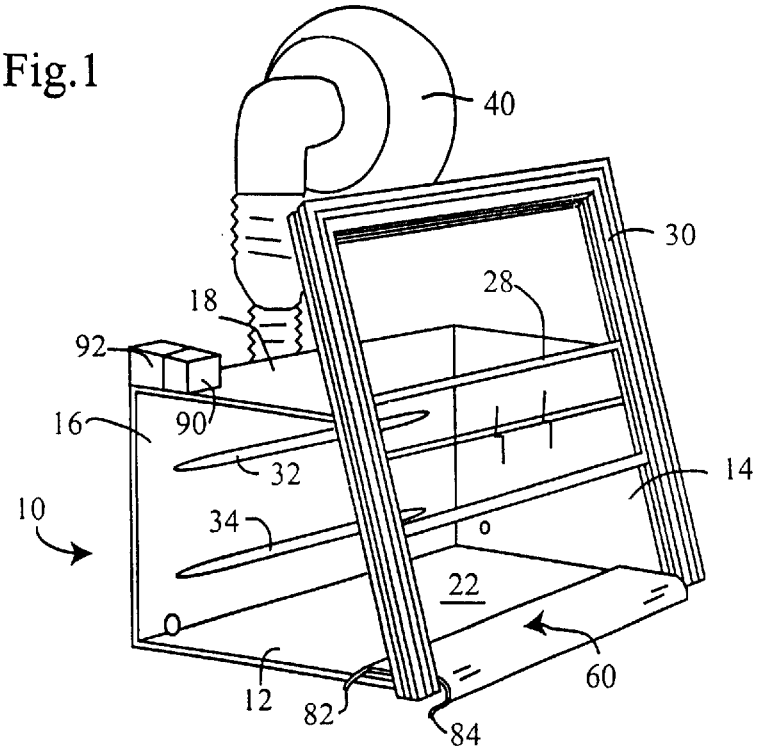
FIG. 1 is a perspective view of the fume hood of the present invention.
Figure 2:
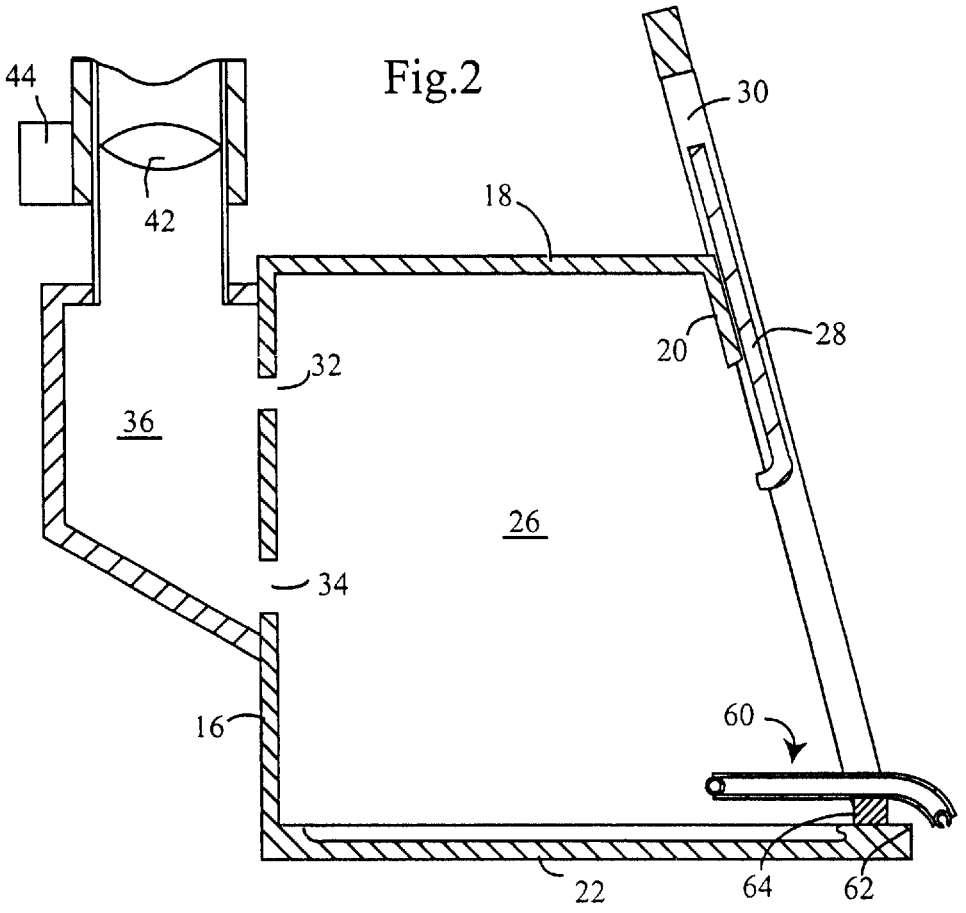
FIG. 2 is a side view of the hood of FIG. 1, along line 2—2.
Figure 3:
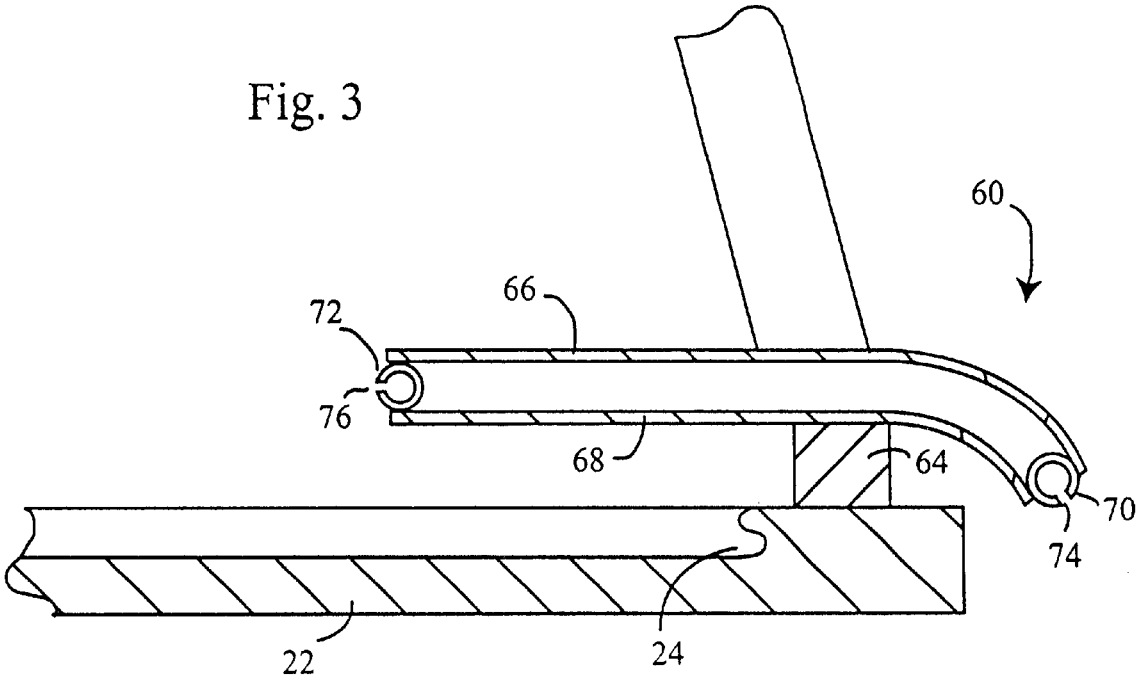
FIG. 3 is a sectional side view of the pitot.
Figure 4:
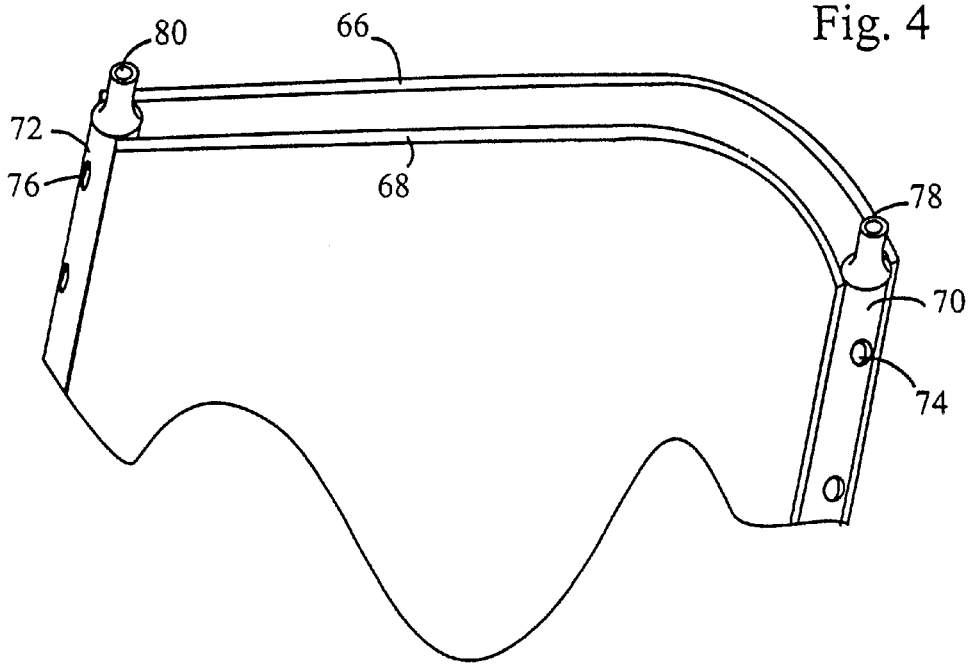
FIG. 4 is a perspective view of the one end of the pitot, as seen from the below, tilted to show the holes in the tubes.

As best illustrated in FIGS. 1 and 2, enclosure 10 is comprised of spaced, parallel side walls 12 and 14; a rear wall 16; and an upper wall formed by a top wall 18 and a front wall 20, extending downwardly from the front edge of top wall 18. Enclosure 10 also includes a bottom wall or floor 22 with raised edges to form a spill collection sink. Inwardly curved front shoulder or edge 24, best shown in FIG. 3, is configured to also enhance laminar air flow within the chamber and prevent air from being discharged along the front edge of the bottom wall, and includes a concave rear face to rearwardly divert air that would otherwise escape from the front of the enclosure.

Walls 12–22 together define a work chamber 26 within which material is manipulated. The front edges of walls 12, 14 and 20, and the front shoulder of bottom wall 22 define an operator access opening into the chamber. A door 28 is slidable within frame 30 to vary the size of the access opening. Rear wall 16 includes horizontal, spaced opening 32 and 34 to allow air to flow from chamber 26. Plenum 36 communicates with chamber 26 through openings 32 and 34 in wall and exhaust conduit 38.

Contaminated air is drawn through conduit 38 with an inline exhaust fan 40. The volume of air that moves through conduit 38 is regulated with an inline vane 42 that is moveable to any position between fully open and fully closed by a valve actuator 44. The air pressure differential between the interior of chamber 26 and the chamber exterior is sensed by pitot 60 to measure the air velocity at the inlet into the o chamber. Pitot 60, supported above and parallel to lower edge 62 of chamber 26 by pitot mount 64, is comprised of a first and second parallel plates 66 and 68, each having a front and a rear edge, and front and rear parallel tubes 70 and 72 positioned adjacent and between the front and rear edges of plates 66 and 68.

Each pitot plate 66 and 68, when mounted on mount 64, is comprised of a generally horizontal rear section within the chamber and a downwardly curved front section extending, to the front of and outside the chamber. Preferably, the front section is about one-half to about one-third the length of the rear section. The front ends of the parallel plates 66 and 68, and thus the front end of pitot 60, incline downwardly at an angle of from about 30° to about 50° below horizontal. That is, a line drawn parallel to the front ends of the pitot plates will be at a 30–50° angle below horizontal.

Front tube 70 includes a plurality of front pitot holes 74 on the front or exterior side of tube 70 that extend radially through the wall of tube 70. When pitot 60 is mounted, holes 74 are directed radially at a downward angle of from about 30° to about 50° below horizontal to minimize the effect of transient air currents. That is, a line through the center of tube 70 and a given hole will be at an angle of from 30–50° below horizontal. Preferably, holes 74 are spaced equidistant along front tube 70, and are separated at a distance of from about 4 to about 8 inches.

Rear tube 72 also includes a plurality of rear tube holes 76 that extend radially through the wall of tube 72. Preferably, holes 76 are also spaced equidistant along the rear tube, with a separation distance normally of from about 4 to about 8 inches. Rear tube holes 76 are positioned to the rear of tube 72 along a horizontal radius parallel to the rear sections of plates 66 and 68. That is, a line drawn through the center of tube 72 and any one of rear tube holes 76 will be approximately horizontal.

Front tube 70 and rear tube 72 contain connectors 78 and 80 in communication with flexible conduits 82 and 84, respectively. Conduits 82 and 84 are connected to holes 78 and 80, respectively, and to transducer 90 to transmit pressure measurements from each tube 70 and 72.

Transducer 90 converts pressure measurements to an electrical value corresponding to actual face velocity. This measured value is then transmitted to controller 92, where the measured value is compared to a preset face velocity value. Due to the high sensitivity of the present sensor, the face velocity can be as low as 5 linear feet per minute (LFPM), although higher rates of flow, up to, e.g. 100 LFPM can also be accurately measured. If the values are different, controller 92 instructs actuator 44 to change the position of vane 42, as necessary to increase or reduce airflow through chamber 26 as appropriate, to adjust the face velocity to the preset value.

Over time, the pressure differential at the face of chamber will change, often abruptly. These changes can result from various factors, such as changing of the door position, insertion of an operator's arms through the opening, or even an individual walking past the hood. As a result, a rapid adjustment of airflow may be required in order to prevent leakage, or to prevent excessive and unnecessary airflow. The pivot of the present invention is capable of rapidly measuring changes in pressure with a high degree of accuracy. The remainder of the control system is designed to respond to such changes so that airflow volume can be quickly adjusted to the desired level.

Certain modifications and improvements will occur to those skilled in the art upon reading the foregoing description. It should be understood that such modifications and improvements have been deleted herein for the sake of conciseness and readability but are properly within the scope of the following claims.

What is claimed is:

1. A fume hood comprising:

a) a chamber having in inlet and an outlet;

b) a vacuum source for drawing air through said inlet and said chamber, and out of said outlet;

c) an airflow regulator for creating a predetermined air velocity through said air inlet; and d) a pitot with front and rear edges in communication with said regulator to measure air velocity at said inlet, said pitot including an interior air pressure sensor and an exterior air pressure sensor, said interior air pressure sensor, said pitot including a substantially horizontal rear section with a rear end extending into said chamber and a downwardly curved front section with a front end extending out of said chamber, said exterior air pressure sensor being positioned at the front end of said pitot and said internal air pressure sensor being positioned at the rear end of said pitot including rear openings aligned substantially along the horizontal radius of said interior sensor.

2. The fume hood of claim 1, further including a conduit extending outwardly from said outlet to said vacuum source, said airflow regulator including a valve within said conduit moveable to any position between fully open and fully closed to regulate the volume of air drawn through said conduit.

3. The fume hood of claim 1, wherein said air flow regulator includes a transducer in communication with said pitot to convert pressure measurements into an electrical value indicating the difference in pressure between said chamber interior and said chamber exterior, a processor in communication with said transducer to calculate actual air velocity based upon said measurements and compare said measured actual air velocity against a preset value, and an actuator in communication with said processor to receive a signal when said actual air velocity is different from said preset value.

4. The fume hood of claim 1, wherein said inlet has a horizontal lower edge, and said pitot is supported above and parallel to said lower edge, whereby air flows under and over said pitot.

5. The fume hood of claim 1, wherein the exterior and internal air pressure sensors are in the form of front and rear tubes, respectively, positioned substantially parallel to said inlet, each tube having a continuous wall defining a hollow interior, said front tube including a plurality of openings through said front tube wall in communication with said front tube interior, the openings in said exterior sensor being directed away from said chamber, and said rear tube including a plurality of openings through said rear tube wall in communication with the interior of said rear tube, the openings into said rear tube interior being horizontally aligned with the axis of said tube.

6. The pitot of claim 1, including spaced, parallel plates, said air pressure sensors being positioned between said plates.

7. A fume hood having a work chamber with an inlet and an outlet, an air flow regulator for maintaining a predetermined air velocity through said inlet into said chamber, and a pitot in communication with said air low regulator to measure air velocity at the inlet of said chamber, said pitot comprising:

a) upper and lower surfaces, a substantially horizontal rear section extending into said chamber, a front section extending to the exterior of said chamber, a front edge and a rear edge;

b) an exterior air pressure sensor at the front edge of said pitot, said exterior sensor being a first tube positioned substantially parallel to said inlet, said first tube including a continuous wall defining a hollow interior, and at least one air access opening in said wall in communication with said interior and being inclined downwardly at an angle of from about 30° to about 50°; and c) an interior air pressure sensor at the rear edge of said pitot; said interior air pressure sensor including said interior air pressure sensor including a hollow interior and rear openings into said interior substantially equidistant between said upper and lower surfaces.

8. The pitot of claim 7, wherein said interior sensor is a second tube positioned substantially parallel to said inlet, said first tube including a continuous wall defining a hollow interior, and at least one air access opening in said wall in communication with said interior, said opening extending horizontally toward the interior of said chamber.

9. The pitot of claim 8, including spaced, parallel plates, said air pressure sensors being positioned between said plates.

10. The pitot of claim 7, wherein the length of said front section is from about one-half to about one-third of the length of said rear section.

11. The pitot of claim 8, wherein said at least one air opening is horizontal.

12. The pitot of claim 7, wherein said at least one air opening is a plurality of spaced openings.

13. The pitot of claim 8, wherein said at least one air opening is a plurality of spaced openings.

14. A pitot to measure air velocity at the inlet of a fume hood chamber comprising:

a) a substantially horizontal rear section extending into said chamber and a front section extending to the exterior of said chamber, said airfoil having upper and lower surfaces, a front edge and a rear edge;

b) a front air pressure sensor including downwardly inclined openings at the front edge of said airfoil; and c) a rear air pressure sensor at the rear edge of said pitot said rear sensor including openings substantially equidistant between said upper and lower surfaces, said sensors being in the form of tubes positioned substantially parallel to said inlet, each tube having a continuous wall defining a hollow interior, said openings in said rear sensor being in communication with said interior.

15. The pitot of claim 14, including of spaced, parallel plates, said air pressure sensors being positioned between said plates.

* * * * *